US006029131A

United States Patent [19]

Bruckert

[11] Patent Number: 6,029,131

[45] **Date of Patent: *Feb. 22, 2000**

[54] POST PROCESSING TIMING OF RHYTHM IN SYNTHETIC SPEECH

[75] Inventor: Edward A. Bruckert, Maynard, Mass.

[73] Assignee: Digital Equipment Corporation, Maynard, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/670,856

[22] Filed: Jun. 28, 1996

[51] Int. Cl.[7] ..... G10L 5/04

[52] U.S. Cl. ..... 704/260; 704/267

[58] Field of Search ..... 395/2.28, 2.63; 704/254, 2, 200, 258, 260, 266, 267, 268, 270, 277

[56] References Cited

U.S. PATENT DOCUMENTS 4,799,261 1/1989 Lin et al. ..... 395/2.28
4,979,216 12/1990 Malsheen et al. ..... 704/260
5,384,893 1/1995 Hutchins ..... 704/267
5,715,368 2/1998 Saito et al. ..... 704/268

*Primary Examiner*—David R. Hudspeth
*Assistant Examiner*—Donald L. Storm
*Attorney, Agent, or Firm*—Cesari and McKenna LLP

[57] ABSTRACT

A method for generating synthetic speech uses detection of natural timing boundaries in words to be spoken by the synthetic speech system, to produce natural timing intervals. Phonemes are identified in the natural timing intervals. Time durations are assigned for each of the phonemes. A time duration of a selected phoneme is changed to achieve a desired time duration for a selected natural timing interval containing the phoneme. The natural timing interval may be selected to be a syllable. The natural timing interval may be selected to be the interval between two stressed phonemes. The natural timing intervals may be set to substantially the same duration between timing boundaries by changing the phoneme durations in accordance with rhythm of the language of synthesized speech. Durations of preselected phonemes, however, may remain unchanged.

17 Claims, 11 Drawing Sheets

ADJUST TIME DURATION OF PHONEMES
BASED ON POSITION IN A SYLLABLE

1. SELECT A REFERENCE TIME DURATION FOR ALL SYLLABLES
2. DETERMINE AN ADJUSTMENT FOR EACH SYLLABLE TO MAKE ALL SYLLABLES OF EQUAL DURATION.
3. APPLY THE SYLLABLE ADJUSTMENT TO EACH PHONEME WITHIN THE SYLLABLE, RECOGNIZING THAT SOME PHONEMES ARE MORE ADJUSTABLE THAN OTHERS.
4. CREATE A TIMING FILE HAVING A BYTE INDICATING TIME DURATION FOR EACH PHONEME.

FIG. 8

POST PROCESSING TIMING OF RHYTHM IN SYNTHETIC SPEECH

FIELD OF THE INVENTION

This invention relates to generation of synthetic speech, and more particularly to timing of phonemes in order to produce a desired synthetic spoken pattern.

BACKGROUND

Timing in speech synthesis is an important factor in the sound of the spoken words.

The timing of synthesized phonemes in spoken words of different languages requires rules which are consistent with the particular language. Languages are classified as to timing into at least two groups, languages with stress timed rhythm including English and German, and languages with syllable timed rhythm including Spanish and French.

In some languages, such as English and German, native speakers generate approximately equal timing between stressed syllables, and these languages are referred to as having stress timed rhythm.

However, in other languages such as Spanish and French, native speakers generate a strong component of syllable timing, referred to as syllable timed rhythm. In syllable timed rhythm, the speaker places substantially equal time duration on each syllable as the words are spoken.

Both languages with stress timed rhythm and languages with syllable timed rhythm are often synthesized by simply assigning an inherent time duration to each phoneme, modifying the duration with timing rules, and therefore allowing the time duration between rhythm elements to be synthesized by simply adding the time duration of the intervening phonemes.

Although intelligible speech may be produced by simply assigning durations to the phonemes, an improvement is needed so that the sound of the synthesized speech may be produced by more accurately timing the rhythm to correspond with rhythm elements of the language.

There is needed a way to produce synthesized speech so that the time duration of a sequence of phonemes can be adjusted to a desired value.

SUMMARY OF THE INVENTION

A method for generating synthetic speech uses detection of natural timing boundaries in words to be spoken by the synthetic speech system, to produce natural timing intervals. Phonemes are identified in the natural timing intervals. Time durations are assigned for each of the phonemes. A time duration of a selected phoneme is changed to achieve a desired time duration for a selected natural timing interval containing the phoneme. The natural timing interval may be selected to be a syllable. The natural timing interval may be selected to be the interval between two stressed phonemes.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views:

FIG. 8 is a flow table for creating a timing file.

DETAILED DESCRIPTION

Rule Based Speech Synthesis

Figure 1:
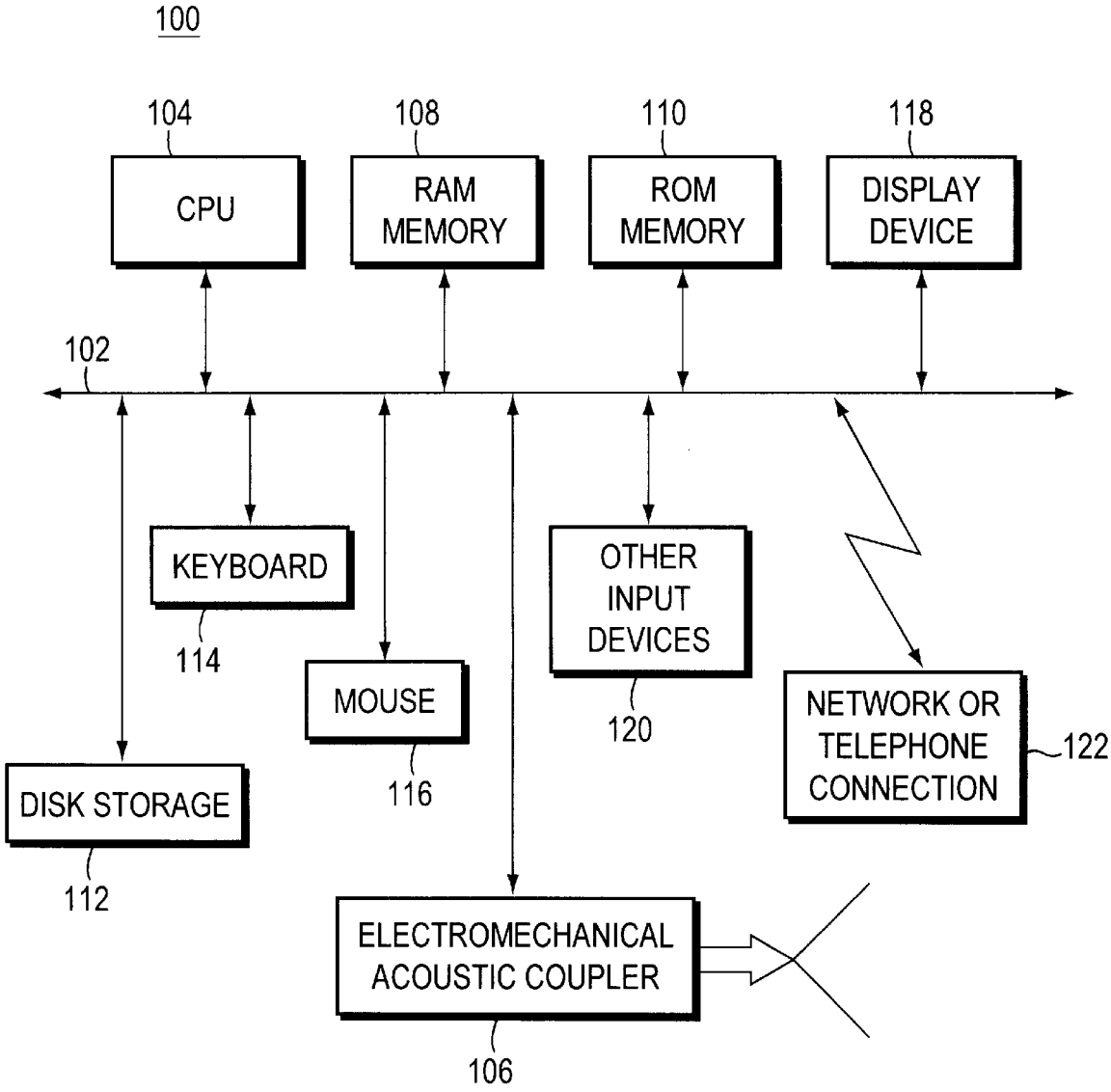
FIG. 1 is a block diagram of a speech synthesis system.

For the purpose of producing synthesized speech, spoken speech may be analyzed into a number of components. At the first level, speech is formed into paragraphs. Synthetic speech systems usually do not take paragraph structure into account in synthesizing speech.

At a second level, speech is formed into sentences. Synthetic speech systems usually take sentence structure into account, at least in distinguishing between a declarative statement and a question. A question is recognized by the trailing question mark, and in synthesized English, the fundamental frequency of the synthesized speech is caused to rise during the last word of the question. The rise of the fundamental frequency in the last word of the question mimics the usual manner of asking a question by a native speaker.

At a third level, speech is broken into individual words. Individual words are usually separated by a pause in synthesized speech. Also, emphasis on an individual word in a sentence may be created in synthesized speech by adjusting, for example, the amplitude or the fundamental frequency of phonemes in the word.

At a fourth level, words are broken into phonemes. A phoneme is a minimally distinct, abstract class of sounds in a language. For example, phonemes for each word in a dictionary are usually listed along with the definitions of the words. In a standard dictionary such as Webster's *New Collegiate Dictionary* published by G. & C. Merriam Co., the phonemes of each word are given. The phonemes are described on a special page and on the inside of the covers of the book.

Each phoneme represents particular sound in a language. The sound represented by a phoneme may be synthesized. The sounds of a sequence of phonemes may be concatenated in an effort to reproduce the sound of the word. However, such simple speech synthesis systems are failures because the precise sound given to a phoneme by a native speaker is dependent upon many factors such as, for example, the phoneme immediately preceding it, the phoneme immediately following it, the placement of stress on a syllable, whether the phoneme is at the beginning or at the end of a word, etc. See *Fundamentals of Speech Synthesis and Speech Recognition,* edited by Eric Keller, published by John Wiley and Sons, Copyright date 1994, for general background on problems in speech synthesis, all disclosures of which are incorporated herein by reference.

The time duration during which a phoneme is sounded in a speech synthesis apparatus is determined by two steps: first an inherent time duration, expressed in milliseconds, is assigned to each phoneme; and secondly, rules are applied to the text, and phoneme length is changed in accordance with the rules.

Ordinarily, the inherent time duration for a phoneme is selected from a table. The selection from a table of the time duration of a phoneme does not take into account the contextual; setting of the phoneme.

The contextual setting of a phoneme is then taken into account by the application of timing rules. The timing rules take into account factors such as stress, position, leading and trailing phonemes, etc.

A common form of speech synthesis system uses timing rules. Assignment of an "inherent timing interval" to a phoneme followed by "timing rules" which adjust the time duration of the phoneme is referred to as a "rule based speech synthesis system". Often the rules must be applied serially, with the first rule applied first, the second rule applied second, and so forth. In a modern rule based speech synthesis system, there may be at least 50 and perhaps more than 100 rules for detailed timing assignment to phonemes. The sound assigned to a particular phoneme depends upon the factors mentioned above, such as: placement of the phoneme at the beginning of the word or the end of the word; the phoneme which precedes it; the phoneme which follows it; the placement of stress within a word; the placement of stress on a word in a sentence; whether the sentence is a declarative statement or a question; and many other details of the speech to be synthesized. For an example of a rule based speech synthesis system, see Edward Bruckert, Martin Minnow, and Walter Tetachner, *Three-tiered Software and VLSI Aid Developmental System to Read Text Aloud, "Electronics"*, Apr. 21, 1983, published by McGraw Hill, all disclosures of which are incorporated herein by reference.

Syllable Timed Rhythm

Turning now to FIG. 1, there is illustrated a synthetic speech system. System 100 is an exemplary apparatus for production of synthetic speech. Bus 102 provides a data communication path between components of the system 100. The central processor unit, CPU 104, executes instructions which convert data stored in memory to sounds produced by electromechanical acoustic coupler 106. The data stored in memory may be stored in random access memory RAM, read only memory ROM 110, or disk storage memory 112. Alternatively, the data may be typed into keyboard 114, stored temporarily in a memory device as mentioned above, or written directly into registers (not shown) of the CPU 104. Alternatively, a mouse 116 may be used to select words from a menu presented on the screen of a display device 118, and the word is then spoken through electromechanical acoustic coupler 106. As a further alternative, input controlling spoken words may be obtained from "other input devices" 120. As an example of "other input devices", a person may trigger a detector capable of sensing the presence of a person, and the detection then triggers the system 100 to speak text stored in ROM 110, or stored on disk storage 112. As a still further example, text to be synthesized into speech may arrive as electronic mail over a network or telephone connection 122.

Electromechanical acoustic coupler 106 may be, for example, a loudspeaker. Alternatively, electromechanical acoustic coupler 106 may be headphones, or may be a small earpiece such as a hearing aid earpiece.

In one preferred embodiment, system 100 has a small set of sentences to be spoken which are stored in ROM 110, and the text is read into CPU 104 by action of "other input device" 120. An example is an automobile speech synthesis system, where the electromechanical acoustic coupler 106 is a loudspeaker, and phrases spoken include: "fasten your seatbelts"; "your lights are on"; the gas tank is nearly empty";, and etc., all in response to various detectors installed in the automobile. In another preferred embodiment, the text to be synthetically spoken is stored in computer files on disk in disk storage 112. For example, an entire 1,000 page book of prose or poetry may be stored as ASCII files on a disk, and the system 100 reads the text aloud through the action of CPU 104 developing electrical signals which are communicated by bus 102 to electromechanical acoustic coupler 106 where they are rendered audible, as by a loudspeaker or headphones.

Figure 2:
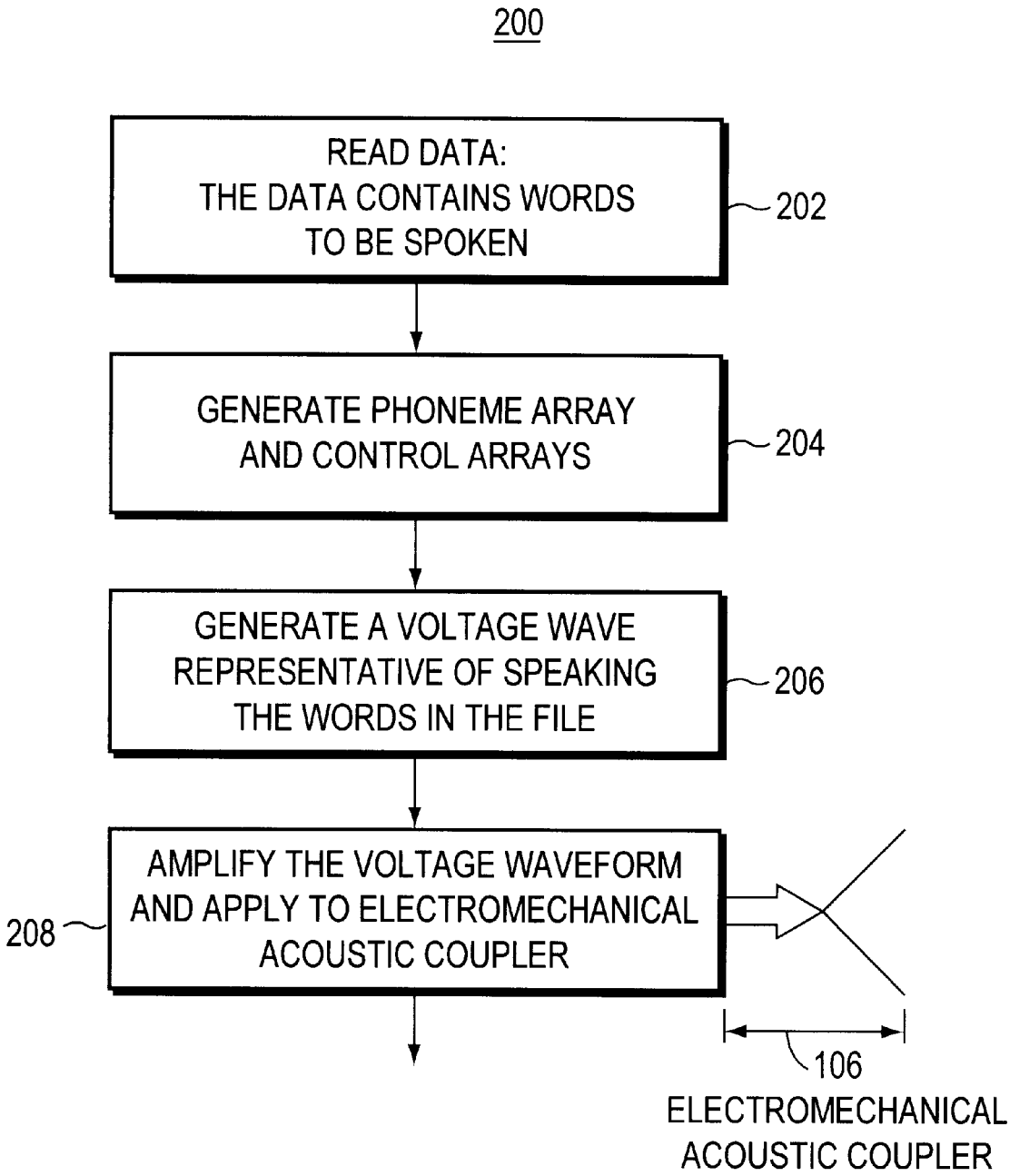
FIG. 2 is a flow chart of a process which may be used in one embodiment of the present invention.

Turning now to FIG. 2, there is shown a typical process 200 of the present invention for execution in CPU 104 for the purpose of synthesizing speech. Data is read by CPU 104 at block 202. The data may be read from ROM memory 110, may be read from disk storage 112, may be read from e-mail arriving at system 100 from network or telephone connection 122, or from any other source of data. At block 202, process 200 parses the data into individual words to be spoken. Process 200 then proceeds to block 204.

At block 204, process 200 creates an array of phonemes and a corresponding control arrays. The array of phonemes and the control arrays control generation of a voltage waveform which is representative of the words to be spoken. The voltage waveform is generated at block 206. The voltage waveform, after proper amplification, is then applied to the electromechanical acoustic coupler 106 at block 208. The electromechanical acoustic coupler 106 then creates sound waves in the air by being driven by the voltage waveform.

As an example of a system for generating electrical audio signals to apply to an electromechanical acoustic coupler such as a loudspeaker reference is made to the Klatt synthesizer. The Klatt synthesizer is described at page 122 of the book *Fundamentals of Speech Synthesis and Speech Recognition* edited by Eric Keller, and mentioned herein-above.

Figure 3:
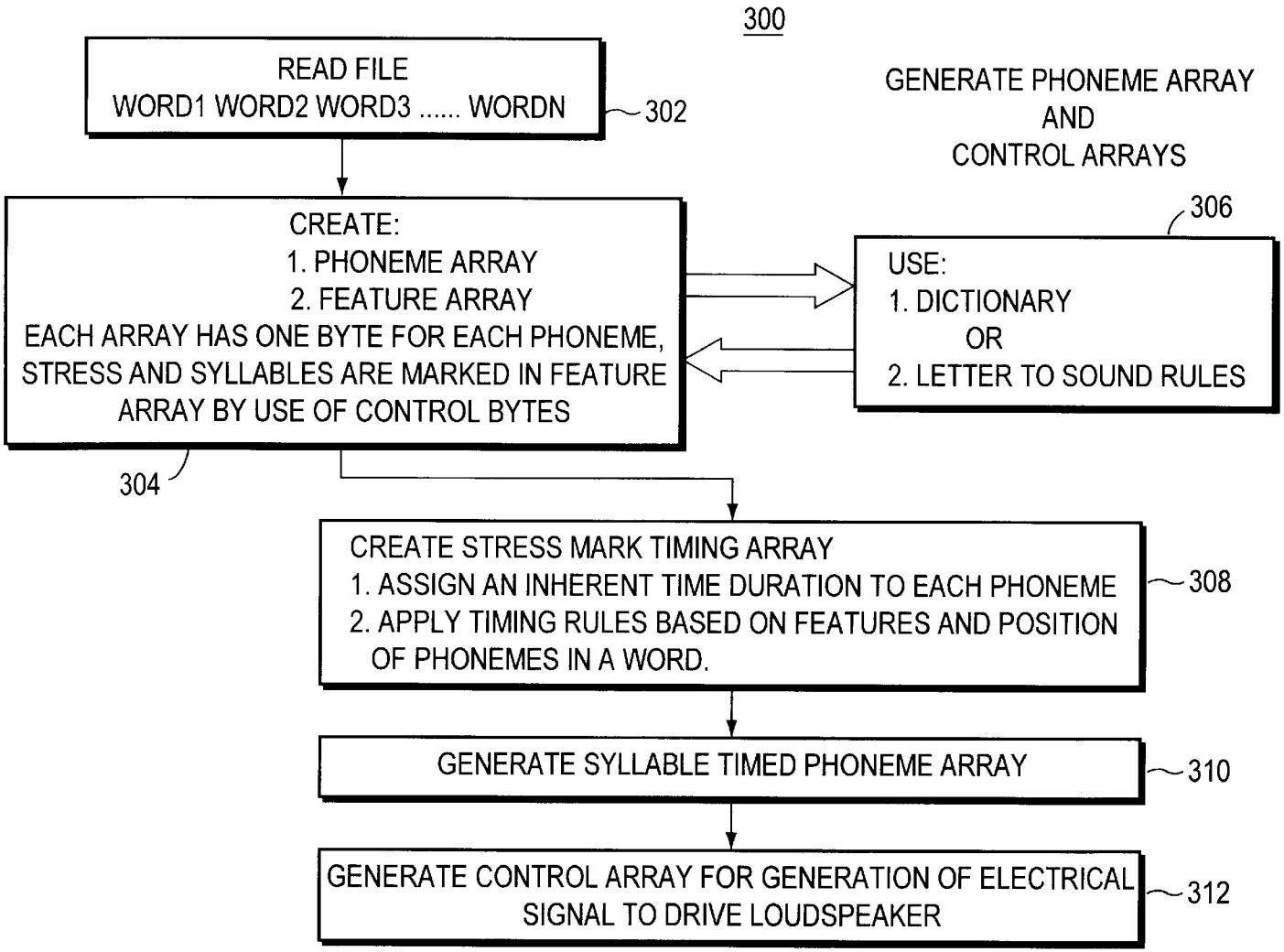
FIG. 3 is a flow chart illustrating a process for generating phonemes and control arrays in one embodiment of the present invention.

Turning now to FIG. 3, there is shown more detail of the process block 204, where the array of phonemes and the control arrays are generated. At block 302 the input data is parsed into words to be spoken. Individual words are indicated as "word1", "word2", "word3", . . . "wordN", etc. The individual words are then delivered to block 304.

Figure 4A:
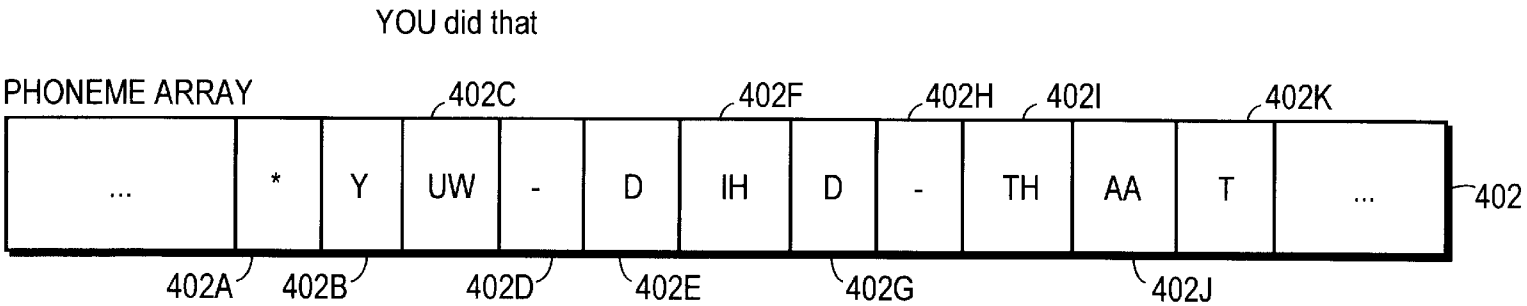
FIGS. 4A–4C are a phoneme array, a feature array, and an index array.

At block 304 each word is translated into a phoneme array 402 as shown in FIG. 4A. The translation of a word into a phoneme array proceeds at block 306 by use of a dictionary, or alternatively, by use of a rules for translation of letters into sounds. In the event that the rules occupy less storage space in system 100 than does a dictionary, then it is advantageous to use the rules rather than a dictionary. In any event, the translation from words to phonemes can always be accomplished by use of a dictionary.

In the synthesis of spoken Spanish language, it is often advantageous to use rules for translation of letters to sounds rather than to use a dictionary, because Spanish language requires only a few simple such "letter to sound translation rules". Accordingly, such rules occupy less storage space in system 100 than does a full Spanish language dictionary for translation of words into a phoneme array. Rules for translation of letters in words to sounds in a language are well known to those skilled in the art of speech synthesis. These letter to sound rules are not part of the present invention.

Phoneme array 402 has entries which correspond to phonemes of the language being synthesized, and also has entries giving boundaries of syllables, and entries giving boundaries of words which are being synthetically spoken.

Figure 4B:
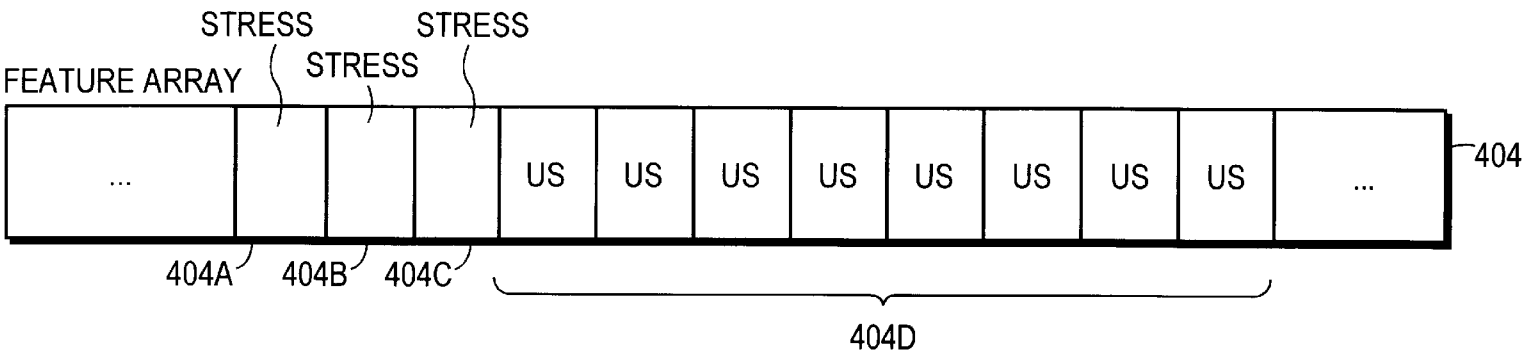
Figure 4C:
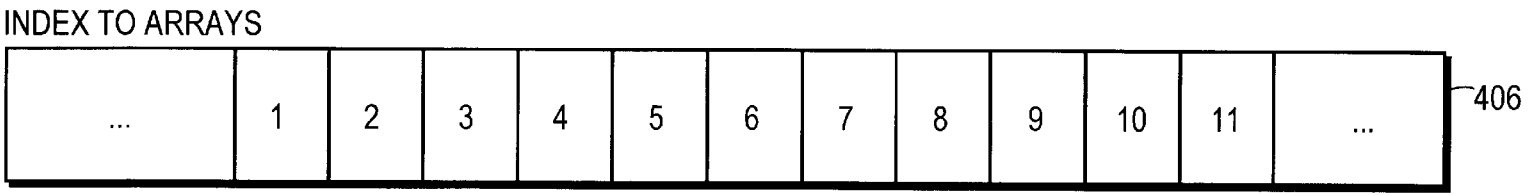

Block 304, in addition to creating phoneme array 402, creates feature array 404 as shown in FIG. 4B. The feature array 404 has an entry for each phoneme in phoneme array 402. Additionally, index array 406 maintains an index into the phoneme array 402 and the feature array 404. Each entry of the index array is a number, ordered in ascending order, which points to a corresponding entry in both the phoneme array 402 and the feature array 404. Index array 406 merely provides an index into the phoneme array and the feature array; and in an exemplary embodiment, index array 406 need not be maintained in memory, as the index values may be generated by the system as they are needed.

In an exemplary embodiment, the phoneme array 402 has a byte of 8 bits for each phoneme, feature array 404 has a byte for each entry in the phoneme array, and index array 406 has one byte entries which point to entries in the corresponding phoneme array 402 and feature array 406.

As an example using English language to illustrate the invention, the phrase "You did that" is translated into a phoneme array as the entries in phoneme array 402, and feature array 404. The word "you" is emphasized, as in "YOU did that" in the entries in feature array 404. Note that entries 404A, 404B, 404C, which correspond to the "beginning stress" symbol "*" 402A, phoneme "y" 402B, and phoneme "uw" 402C, indicate stress. The feature entries for the remaining phoneme entries, word boundary "-" 402D, "d" 402G, "ih" 402F, "d" 402G, word boundary "-" 402H, "th" 402I, "aa" 402J, and "t" 402K all have their corresponding feature entry indicated as un-stressed as "us" 404D.

Figure 5A:
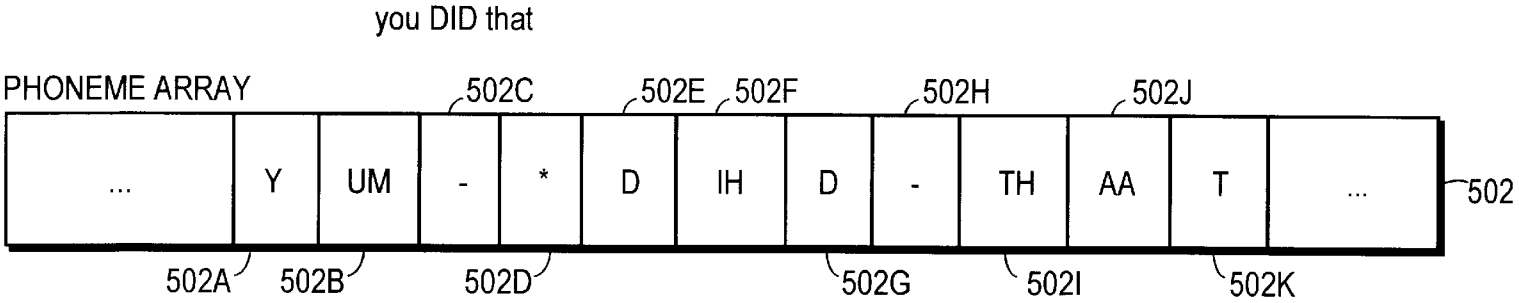
FIGS. 5A–5C are a phoneme array, a feature array, and an index array.
Figure 5B:
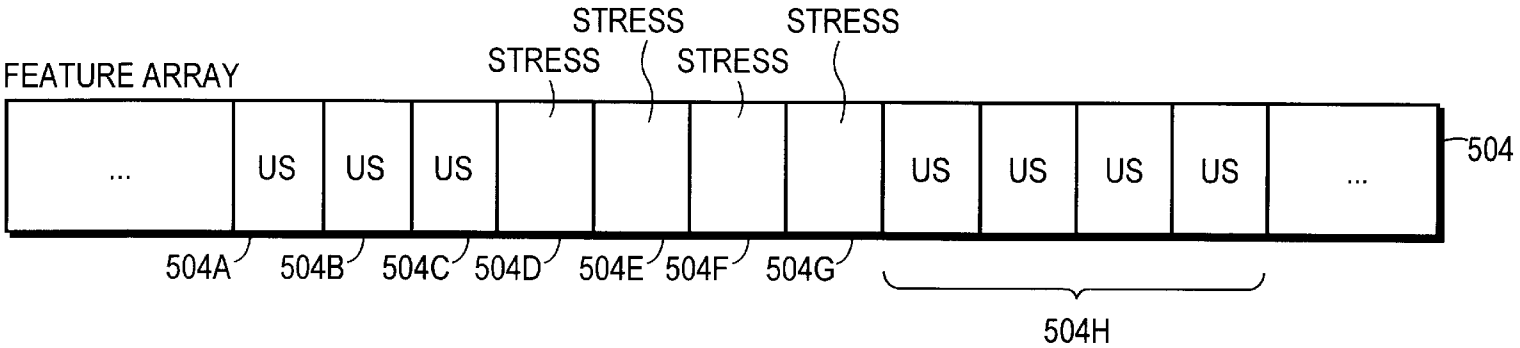
Figure 5C:
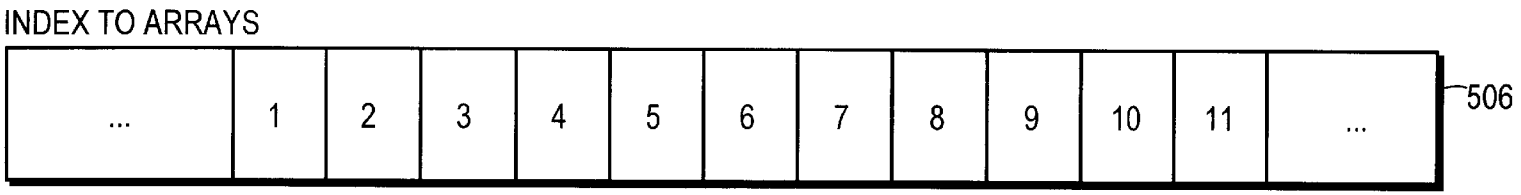

An alternative example of the feature array for the same phrase "You did that" is given in FIG. 5A, FIG. 5B, and FIG. 5C. In feature array FIG. 5B, the stress is placed on the word "did", so that the synthesized speech will have the sound of "You DID that". That is, the emphasis is placed on the second word "DID" in the example of FIGS. 5A–5C. Note that there is no beginning stress symbol preceding phoneme "y" 502A, and that the corresponding feature entry 504A is "us" for un-stressed. Also, the entries for the phoneme "uw" 502B is also "us", as is the feature of the word boundary "-" 502C. The "beginning stress" symbol "*" has corresponding feature entry 504D indicating stress. Also, phoneme "d" 502E, "ih" 502F, and "d" 502G have corresponding feature entries all indicating stress, as shown at feature entries 504E, 504F, and 504G. The remaining phoneme array entries word boundary "-" "th" 502I, "aa" 502J, and "t" 502K have entries indicating un-stressed "us" 504H in their corresponding feature entries.

Accordingly, in the exemplary embodiment of FIGS. 5A–5C the stress in the synthesized speech is placed on the phonemes having the corresponding stress features, to produce the audio output corresponding to emphasis on the word "did", as "You DID that.

Returning now to block 304, when process 300 has completed block 304, the phoneme arrays such as 402 or 502 are created, as are their corresponding feature arrays 404 and 504, along with the index arrays 406 and 506 giving pointers into the phoneme array and the feature array. Process 300 then goes to block 308.

At block 308 process 300 creates a timing array having an entry corresponding to each phoneme in the phoneme array, where the entry in the timing array gives an inherent time duration for each phoneme, and a timing interval at each phrase boundary to give the pause between phrases.

An example of inherent time duration assignments to phonemes of the Spanish language are given in Table 1 as follows:

TABLE 1

| | | | | | | | | | |
|---|---|---|---|---|---|---|---|---|---|
| SIL | E_A | E_E | E_I | E_O | E_U | E_WX | E_YX | | |
| 300 | 130 | 130 | 120 | 120 | 115 | 45 | 70 | | |
| E_RR | E_L | E_LL | E_M | E_N | E_NH | E_F | E_S | E_J | E_TH |
| 140 | 120 | 110 | 75 | 75 | 90 | 120 | 125 | 110 | 120 |
| E_BH | E_DH | E_GH | E_YH | E_P | E_B | E_T | E_D | E_K | E_G |
| 50 | 50 | 55 | 100 | 100 | 90 | 100 | 80 | 110 | 100 |
| E_CH | E_Y | E_R | E_Q | | | | | | |
| 150 | 75 | 45 | 20 | | | | | | |

Table 1 uses the prefix "E_" for each phoneme because the language is Espanol in Spanish. The durations given in Table 1 are expressed in milliseconds. The SIL phoneme gives a silence interval in the synthesized speech.

Table 1 gives the inherent duration of Spanish language phonemes, and in addition to the inherent duration, a minimum duration is assigned to each phoneme so that an application of timing rules cannot reduce any phoneme below the minimum duration.

After the inherent time durations are assigned to the phonemes, then timing rules are exercised by the computer in order to determine adjustments to the inherent time durations. The time durations are adjusted according to the timing rules. The number of timing rules applied vary with the quality of the speech synthesis system, but can be more than 50 rules, and may be more than 100 rules.

A few typical timing rules used in Spanish language synthesis are given hereinbelow as follows.

Rule 1. "Consonant after vowel rule". The consonant after vowel rule takes into account the effect of the next segment on the duration of the vowel. First, determine that the phoneme under consideration is a vowel. Then, if the next phoneme is a consonant, refer to an adjustment table which is indexed by consonant to obtain a percentage change of the duration of the vowel.

Rule 2. Take into account phrase-final position. Detect boundaries in a phrase. A boundary can be: a word boundary, a period pause, a comma pause, a compound noun boundary (In English house boat, the sound should be "hous boat", not "housE boat"). If the next structural boundary is a period "." then for all phonemes between the last boundary seen and the "period pause" ".", make the phoneme length 110 percent of the inherent duration. An additional rule is that in English, the final stressed vowel lengthening rule is inhibited or reduced for the last stressed vowel in a phrase.

Rule 3. Unstressed vowels. An unstressed vowel in a vowel-vowel sequence is shortened if there is no boundary separating the two vowels. The lack of a boundary means that the sounds are produced as a single speech element, as opposed to a situation where they are distinct.

Rule 4. A vowel is lengthened after ~n.

The above four timing rules are exemplary of the complex rules which must be executed in order to adjust the time duration during which a phoneme is sounded in a speech synthesis system. These and other such timing rules are known to those skilled in the art of speech synthesis, and these rules are not part of the present invention.

Figures 6A, 6B:
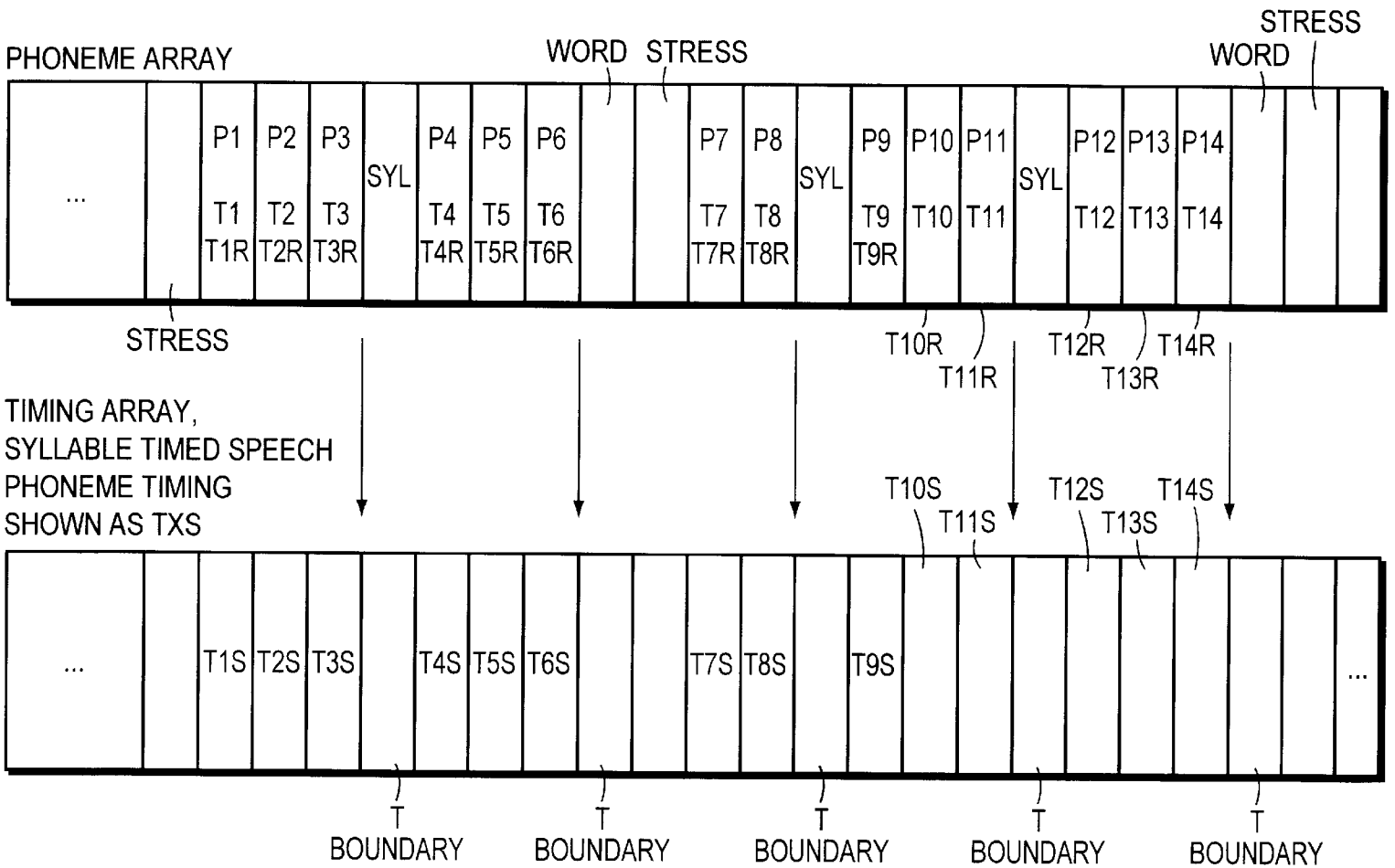
FIGS. 6A–6C are a phoneme array and two timing arrays.

Turning now to FIG. 6A, there are illustrated phonemes in a phoneme array, along with their associated timing array. The phonemes are illustrated as P1, P2, P3, . . . etc. (illustrated as Px). The inherent timing duration assigned to each phoneme is illustrated as T1, T2, T3, . . . etc. (illustrated as Tx). Word boundaries are illustrated as "word" indicia. Syllable boundaries are illustrated by "SYL" indicia. Stressed syllables are illustrated with the indicia "stress" preceding the stressed syllable. Application of the timing rules modifies the inherent time durations assignments, and the timing for each phoneme becomes T1R, T2R, T3R, . . . etc. (illustrated as T×R), where the "R" means the time duration interval after application of the timing Rules. As shown in FIG. 6A, the inherent timing durations are adjusted by the timing rules to become the adjusted timing durations T×R.

FIG. 6B illustrates syllable timed speech. FIG. 6B illustrates further adjustment of the timing durations of the phonemes Px of FIG. 6A, where the further adjustment in phoneme timing duration has been done to make the time duration substantially equal for each syllable. The phoneme time durations are indicated as T×S, where the "S" stands for syllable timed speech. The average syllable time duration is computed, as one number. Syllables are then adjusted to have a time duration approaching the average value. That is, shorter syllables are lengthened and longer syllables are shortened.

Figure 6C:
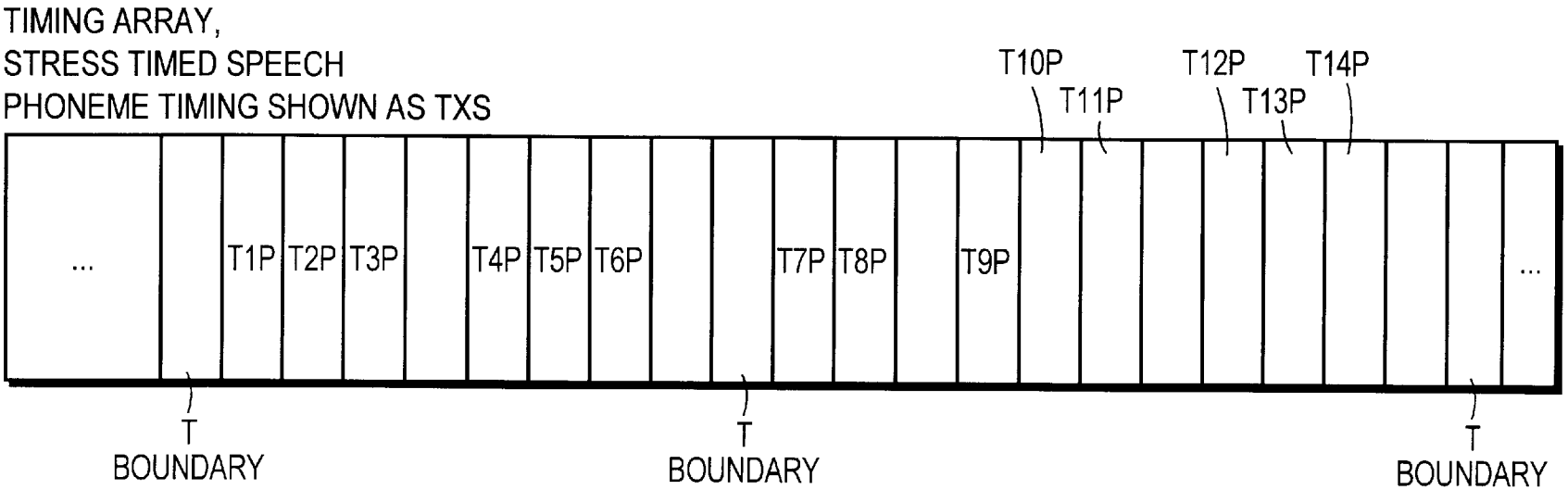

FIG. 6C illustrates stress timed speech. FIG. 6C also illustrates further adjustment of the time durations of the phonemes Px of FIG. 6A, where in FIG. 6C the time intervals between stress marks are adjusted to be substantially equal. The timing durations for stress timed speech are indicated in FIG. 6C by the indicia T×p, where the "p" stands for stress timing.

In both the syllable timed rhythm illustrated in FIG. 6B and the stress timed intervals illustrated in FIG. 6C, a post processing step has been applied to the output of the normal rule based speech synthesis system., The post processing step takes into account timing boundaries which are desired in the synthesized speech. The timing boundaries are utilized by the post processing step to adjust phoneme time durations to give substantially equal timing during the timing boundaries.

Process 300, at block 308, uses the timing rules which are based upon the position of phonemes in a word, and the features assigned to a phoneme in the feature array, to generate the corresponding timing entries of FIG. 6B. Upon completion of block 308, process 300 goes to block 310.

Referring back to FIG. 3, process 300, at block 308, calculates the time duration of each syllable, based upon the inherent phoneme timing durations, and also the usual timing rules. For syllable timed rhythm a desired time duration of each syllable is determined by process 300. At block 310, process 300 compares the desired syllable time duration with the duration provided by the timing array of FIG. 6A. An "excess duration" is computed for syllables which have a time duration greater than the desired syllable duration. A "deficiency duration" is computed for each syllable which has a time duration less than the desired syllable duration.

Phonemes of the language are subdivided into groups, where the groups indicate the amount by which a phoneme may be changed in time duration, or may not be changed in time duration. Physical factors in sound formation in a speaker's larynx, throat, mouth, and tongue set the extensibility, or lack of extensibility, of a phoneme. For example, a "plosive", which is produced by a rush of air during speaking, such as blocking the passage of air with the tongue and then suddenly releasing it, as in the English language sound of "d", or "t", can not be made shorter than the mechanical response time of the acoustic chambers of the voice. Accordingly, plosives are ordinarily assigned to a group of phonemes which are restricted in the amount by which their time duration can be changed. Alternatively, vowels such as "a", "e", "i", "o", and "u" may usually be spoken in a short manner, or may be spoken with a longer or slower manner. Accordingly, vowels may usually be assigned to a group of phonemes which may be changed in time duration.

As an exemplary embodiment of the invention, phonemes are divided into only two groups, those which can be changed in time duration referred to as the "extensible group", and those which cannot be changed in time duration referred to as the "fixed group".

At block 310, the process 300 shortens or lengthens the phonemes in the extensible group in order to make the syllables have the desired average syllable time duration. In an exemplary embodiment of the invention, all phonemes of the extensible group in a syllable share equally the adjustment needed to make the syllable have the desired time duration. Phonemes in the fixed group remain with the time duration assigned in block 308. The result of the action of block 310 is to make each syllable have the same time duration, as is desired in order to achieve the desired speaking rate. Block 310 then creates "syllable timed timing array" as shown in FIG. 6B. The syllable timed timing array is then output by block 310 to block 312.

Block 312 then uses the phoneme array of FIG. 6A, the feature array of FIG. 4B or FIG. 5B, and the "syllable timed timing array" of FIG. 6B in order to generate an audio control array. The audio control array is a typical audio file of the type that is used to operate a sound generation card in a computer. For example, the control array may operate the well known commercial "Sound Blaster" card for use in a standard pc personal computer.

The alternative generation of stress timed rhythm is illustrated in FIG. 6C. When stress timed rhythm is being generated by process 300, the timing boundaries used by process 300 are the stress marks, illustrated as "stress" in FIG. 6A.

As an example of the invention using syllable timed rhythm, Spanish language phonemes are shown in Table 2. The Spanish language phonemes are divided into two groups, sonoronts, indicated as SONOR; and non-sonoronts indicated as NON-SONOR. At block 312 of process 300 the sonoronts may have their time duration changed in order to create syllable timed rhythm in the synthesized speech. On the other hand, the non-sonoronts are unchangeable in the time duration assigned to them by block 308. In this exemplary embodiment of the invention the time duration of a syllable is adjusted to the desired time duration by changing the length of time duration of the sonoronts.

TABLE 2

| Spanish (Espanol) Language Phonemes | |
|---|---|
| SIL | SONOR |
| E_A | SONOR |
| E_E | SONOR |
| E_I | SONOR |
| E_O | SONOR |
| E_U | SONOR |
| E_WX | SONOR |
| E_YX | SONOR |

TABLE 2-continued

| Spanish (Espanol) Language Phonemes | |
|---|---|
| E_RR | SONOR |
| E_L | SONOR |
| E_LL | SONOR |
| E_M | SONOR |
| E_N | SONOR |
| E_NH | SONOR |
| E_F | NON-SONOR |
| E_S | NON-SONOR |
| E_J | NON-SONOR |
| E_TH | NON-SONOR |
| E_BH | SONOR |
| E_DH | SONOR |
| E_GH | SONOR |
| E_YH | NON-SONOR |
| E_P | NON-SONOR |
| E_B | SONOR |
| E_T | NON-SONOR |
| E_D | NON-SONOR |
| E_K | NON-SONOR |
| E_G | NON-SONOR |
| E_CH | NON-SONOR |
| E_Y | NON-SONOR |
| E_R | SONOR |
| E_Q | NON-SONOR |
| E_Z | NON-SONOR |
| E_W | NON-SONOR |
| E_NX | SONOR |
| E_IX | SONOR |
| E_MX | SONOR |
| E_PH | NON-SONOR |

In an alternative embodiment of the invention, syllables are only partially lengthened or contracted toward the desired uniform syllable timing. Two extremes may be considered, one extreme is that block 312 makes no adjustment to syllable time duration, and so the synthesized speech is spoken as set by the rules imposed by block 308. The other extreme is that the syllables are made to conform exactly with the average syllable timing at block 312. An intermediate option is that syllables may be stretched in time duration, or compressed in time duration, by block 312 to occupy an intermediate time duration between the two extremes. In this exemplary embodiment of the invention, syllable timing may be partially turned on. When syllable timing is not turned on, the timing durations assigned by block 308 are used. When syllable timing is 100% turned on, all syllables have the desired average syllable duration. Alternatively, syllable timing may be turned on only by 10%, or perhaps 50%, or perhaps 75%, and in each of these intermediate options the syllable duration is adjusted by only the stated percentage toward the desired average syllable time duration. This option is referred to as "partial syllable timing".

Partial syllable timing is useful to accommodate different types of material in synthesized speech. For example, a translation from a stress timed language such as English into Spanish may sound better to a Spanish language native when syllable timing is reduced. However, lyrical native passages such as poetry may sound better to a native Spanish speaker when Spanish language is synthesized with syllable timing fully implemented to 100%.

Figure 7:
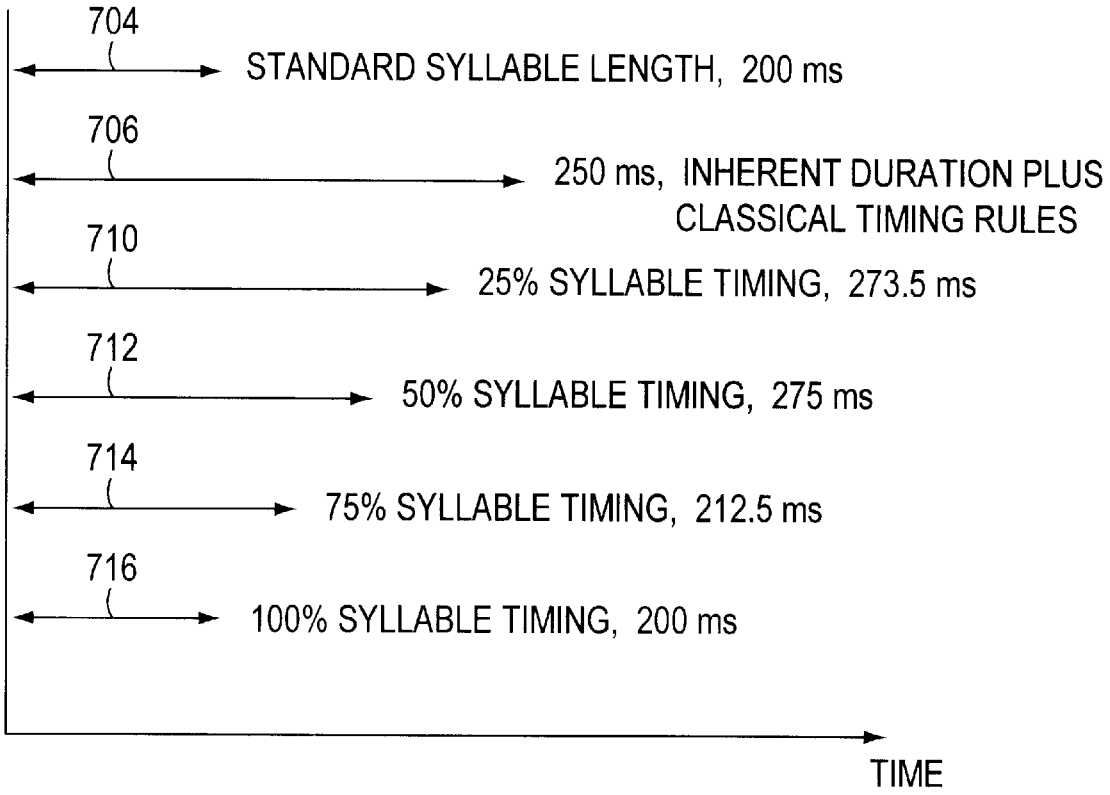
FIG. 7 is a timing diagram illustrating fractional syllable timing.

Turning now to FIG. 7, there is shown a timing diagram illustrating partial syllable timing. Time evolution is shown along axis 702. The units of time as shown in FIG. 7 are milliseconds, abbreviated "ms". Line 704 shows a standard syllable length, given by way of example here as 200 ms. A syllable length of 200 ms is typical for an average speech rate.

Line 706 illustrates a long syllable. The syllable of line 706 is long because when its time duration is calculated from the inherent time durations of the phonemes making up the syllable, it is shown, by way of example, as having a time duration of 250 ms.

Line 710 illustrates the application of 25% syllable timed rhythm. By way of example, the delta time is calculated from the 250 ms from line 706 minus the 200 ms from the standard syllable length illustrated in line 704, to give a delta of 50 ms. By applying a 25% syllable timing correction, the value of 25% times the delta of 50 ms is subtracted from the syllable of line 706, for a subtraction of 12.5 ms. The result is a syllable of time duration of 237.5 ms, as illustrated in line 710. The syllable is compressed to 237.5 ms by equally shortening all phonemes identified as flexible. In the Spanish language example, the flexible phonemes are identified as sonoronts in Table 1, hereinabove.

Line 712 illustrates 50% syllable timing. In 50% syllable timing, 50% of the timing delta is applied to correct the length of a syllable occurring in the speech synthesis. That is 50% of the delta of 50 ms, or 25 ms, is subtracted from the syllable length of 250 ms. The result is a syllable of length 275 ms, as is illustrated in line 712.

Line 714 illustrates 75% syllable timing. In 75% syllable timing, 75% of the delta of 50 ms, that is 37.5 ms, is subtracted from the 250 ms of the original syllable. The result is a syllable of length 212.5 ms, as is illustrated in line 714.

Line 716 illustrates 100% syllable timing, where the adjustable phonemes of the original syllable have been equally compressed so that 50 ms is subtracted from the original syllable, leaving a syllable of 200 ms length.

Apparatus using process 300 given in FIG. 3 may be referred to as a "post processing" system for achieving syllable timed rhythm. The system 300 is a post processing system because blocks 302 through 308 are representative of known synthetic speech generating systems. Block 310 then adds post processing to the known system.

In an alternative embodiment of the invention, rather than using a rule based speech synthesis system to achieve the result of blocks 302 through 308, the system may use any of the newer phonological speech synthesis systems as are described at pages 253–293 in the book *Fundamentals of Speech Synthesis and Speech Recognition* edited by Eric Keller, mentioned herein-above. After application of any of the phonological systems, then the process of block 312 adjusts the timing rhythm to a desired pattern as a post processing step.

Turning now to FIG. 8, there is shown a flow method for adjusting the time duration of phonemes in order to achieve syllable timed rhythm.

At step 1, a Reference time duration is selected for all syllables. That is, all syllables are taken to have the same time duration in order to meet the required speaking rate in words per minute.

At step 2 an adjustment is determined for each syllable. Some syllables will be longer than the reference value, and some syllables will be shorter than the reference value.

At step 3 a delta is computed to either subtract from each phoneme or to add to each phoneme on the assumption that not all phonemes are adjustable. In a simple model, the phonemes are simply divided into two classes, those which can be adjusted and those which cannot be adjusted. The addition or subtraction to the time duration of the adjustable phonemes is then simply calculated.

In a more advanced system, phonemes are assigned an "elasticity" index, giving the amount of adjustment which the phoneme can tolerate and still produce good synthesized speech. In an exemplary embodiment, the phonemes are adjusted in time duration in proportion to the elasticity parameter assigned to the phoneme, and so that the cumulative adjustment adds to the delta assigned to the syllable.

At step 4, a timing file is created. The timing file has, for example, a byte for each phoneme, where the byte indicates the time duration of its associated phoneme.

At a further step, the timing file is used in the generation of a control file for the audio synthesis.

Stress Timed Speech Synthesis

In a speech synthesis system operating in the English language or in the German language, an improvement in speech quality may be obtained by adjusting the timing between stressed phonemes. The method described above, wherein the time duration of some phonemes is adjusted, and the time duration of some phonemes is not adjusted, may be used to obtain equal time for the time interval between stressed elements of the language. Again, this adjustment may be done as a post-processing step after all of the rules are applied to assign sounds to the phonemes. In a stressed timed language, this adjustment from the inherent durations of the phonemes to equal time durations between stressed phonemes may improve the quality of the sound of the synthesized speech.

Also, in a stressed timed language, it may be desirable to only partially accomplish stress timing. For example, the speech synthesis system may be adjusted to introduce no timing adjustment so that the phonemes have their inherent time duration, or alternatively, the time adjustment may be fully applied so that the timing between stressed phonemes is made substantially equal.

Figure 9:
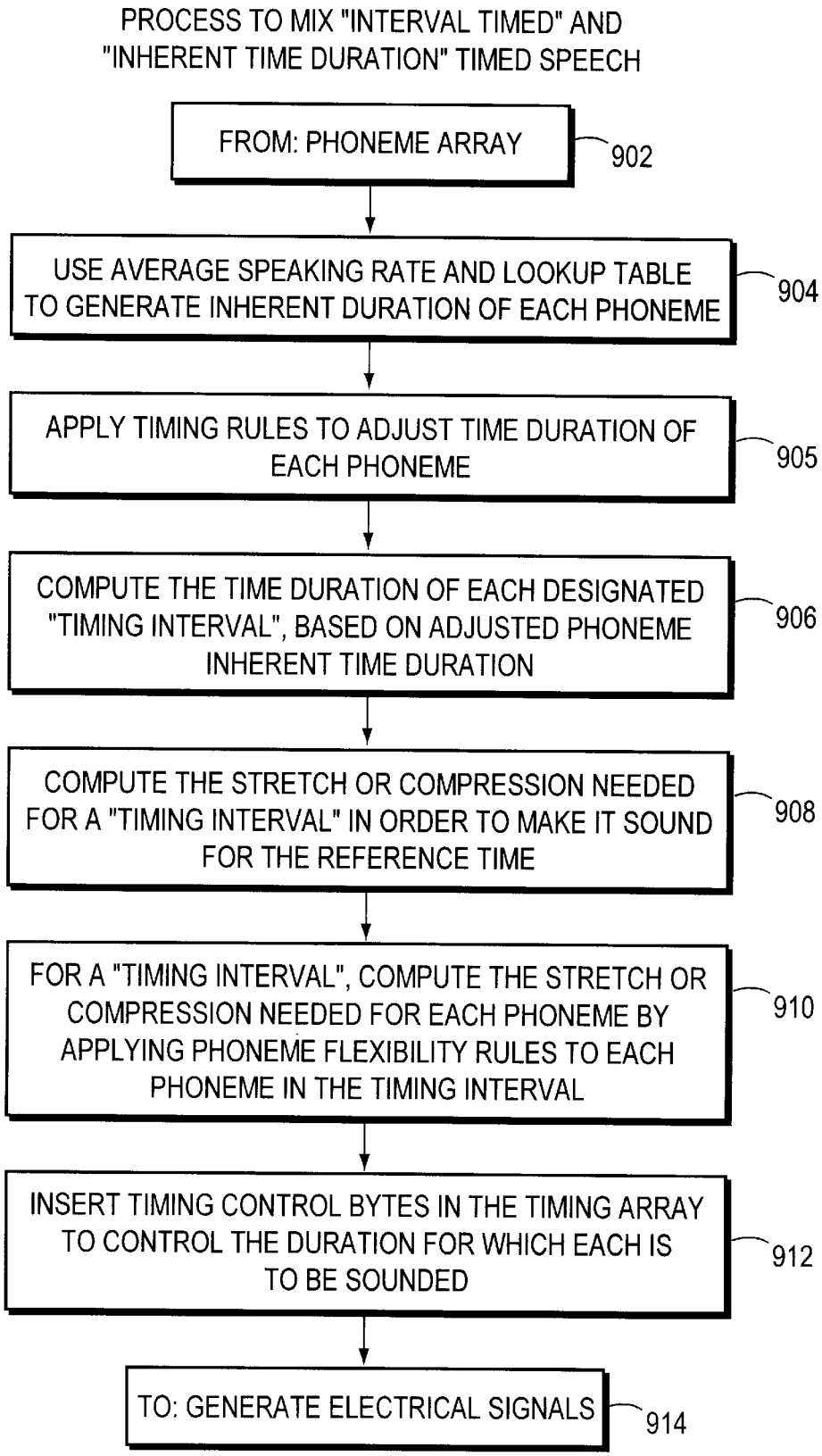
FIG. 9 is a block diagram of a process for mixing "interval" timed with "inherent" timed phoneme time durations.

Turning now to FIG. 9, there is shown a flow diagram for mixing "interval timing" speech synthesis with the results of simple inherent timing intervals. By way of example, the interval for interval timing may be a syllable. Alternatively, the interval may be between stressed phonemes.

At block 902 the process transfers from the step of generating the phoneme array. At block 904 the inherent duration of each phoneme is computed in order to achieve the desired speaking rate.

At block 905 the timing rules, as illustrated in FIG. 6A, are applied to the inherent time durations.

At block 906 the time duration of each "timing interval" is computed from the inherent phoneme durations calculated in block 904. Also a REFERENCE TIME is computed. When each timing interval is sounded for the REFERENCE TIME the desired average speaking rate is achieved. FIG. 6B illustrates the "timing interval" as a syllable for use in synthesizing a syllable timed language such as Spanish or French. FIG. 6C illustrates the "timing interval" to be the interval between stress positions for use in synthesizing a stress timed language such as English or German.

At block 908 the stretch or compression for each timing interval is computed, that is the "delta", in order to make the timing interval sound for the REFERENCE TIME.

At block 910, the stretch or compression for each phoneme is computed. In a simple system, phonemes are classified into two groups, those which are flexible and those which are inflexible. The necessary part of the delta is applied equally to the flexible phonemes. The duration of the inflexible phonemes is not changed from the inherent value.

In more advanced systems, a compressibility factor may be assigned to phonemes. In such a system, the lengthening or shortening of a phoneme is controlled by both the compressibility factor and the delta needed for the timing interval.

In either system, "timing interval" speech synthesis such as syllable timed rhythm may be applied by a desired fractional amount, as described hereinabove for syllable timed rhythm. When the desired fractional application is expressed as X%, then the delta is adjusted by the amount of X%, as described hereinabove for syllable timed speech synthesis.

At block 912 timing control bytes are inserted into the timing array to control the duration for which each phoneme will be sounded when audible speech is generated.

At block 914 the process branches to the process which generates the electrical signals to apply to the electromechanical acoustic coupler such as a loudspeaker.

Figure 10:
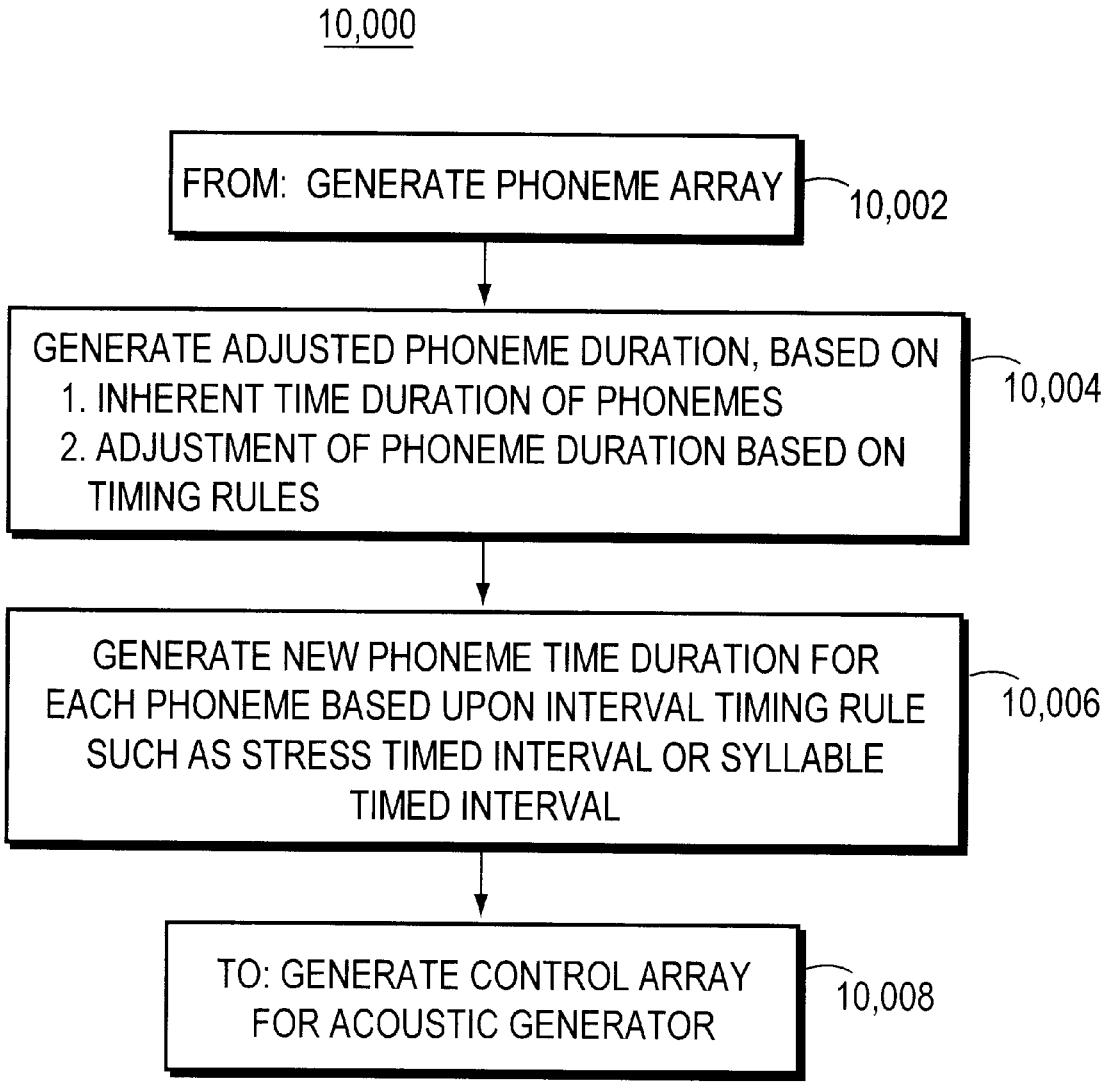
FIG. 10 is a flow chart of post-processing used in one embodiment of the present invention.

Turning now to FIG. 10, the post processing feature of the present invention is illustrated. An advantage of the present invention is that it may be added to a commercially available speech synthesis system which makes use of the ordinary phoneme timing rules. Of course, the present invention may be incorporated fully within a newly developed speech synthesis system. However, the advantage of the present invention which permits it to be added as a post processing step to known speech synthesis systems is more fully illustrated in FIG. 10.

At block 10,002 process 10,000 transfers from the generation of the phoneme array.

At block 10,004 process 10,000 assigns inherent timing intervals to each individual phoneme and applies the timing rules to the inherent phoneme timing durations. Block 10,004 performs the function of the usual rule based speech synthesis system. Process 10,000 then transfers to block 10,006.

At block 10,006 process 10,000 identifies timing boundaries. A timing boundary may be a syllable as in syllable timed rhythm as used in Spanish and French. Alternatively, a timing boundary may be identified as the timing interval between stress marks, as in English and German. The process 10,000 then adjusts the time duration of the adjustable phonemes in order to make the time duration of the synthesized speech substantially equal between the chosen timing boundaries. Process 10,000 then transfers to block 10,008 where the process transfers to a function for generation of the control array for the acoustic generator.

It is to be understood that the above described embodiments are simply illustrative of the principles of the invention. Various other modifications and changes may be made by those skilled in the art which will embody the principles of the invention and fall within the spirit and scope thereof.

What is claimed is:

1. A synthetic speech system comprising:

means for detecting natural timing boundaries in words to be spoken by said synthetic speech system, to produce natural timing intervals;

means for identifying phonemes in said natural timing intervals;

means for assigning first time durations for each of said phonemes;

means for changing a selected first time duration of a selected phoneme to achieve a desired time duration for a selected natural timing interval containing said selected phoneme; and means for setting a plurality of said natural timing intervals to substantially the same second time duration, a particular phoneme having a computed time duration in response to number of phonemes within said selected natural timing interval and said second time duration;

wherein at least said selected first time duration is based upon an elasticity parameter indicative of degree to which said selected first time duration may be adjusted without undesirably degrading speech produced by said system.

2. The system as in claim 1 wherein each natural timing interval is a respective syllable.

3. The system as in claim 1 wherein each natural timing interval is a respective interval between two respective stressed phonemes.

4. A method for generating synthetic speech, comprising;

detecting natural timing boundaries in words to be spoken by a synthetic speech system, to produce natural timing intervals;

identifying phonemes in said natural timing intervals;

assigning first time durations for each of said phonemes;

changing a selected first time duration of a selected phoneme to achieve a desired time duration for a selected natural timing interval containing said selected phoneme; and setting a plurality of said natural timing intervals to substantially the same second time duration, a particular phoneme having a computed time duration in response to number of phonemes within said selected natural timing interval and said second time durations;

wherein at least said selected first time duration is based upon a predetermined parameter indicative of degree to which said selected first time duration may be adjusted without undesirably degrading speech produced by said system.

5. The method of claim 4 further comprising:

selecting each natural timing interval to be a respective syllable.

6. The method of claim 4 further comprising:

selecting each natural timing interval to be a respective interval between two respective stressed phonemes.

7. A synthetic speech system comprising:

means for storing speech to be synthesized in a computer memory;

means for a processor to read said speech from said computer memory and for said processor to detect natural timing boundaries in words to be spoken by said synthetic speech system, to produce natural timing intervals;

means for identifying phonemes in said natural timing intervals;

means for assigning first time durations for each of said phonemes;

means for changing a selected first time duration of a selected phoneme to achieve a desired time duration for a selected natural timing interval containing said selected phoneme;

means for setting a plurality of said natural timing intervals to substantially the same second time duration, a particular phoneme having a computed time duration in response to number of phonemes within said selected natural timing interval and said second time duration; and means for applying said synthesized speech to an electromechanical acoustic coupler to make audible speech;

wherein respective time durations of at least certain respective phonemes are based upon respective selectable parameters indicative of respective degrees to which said respective time durations may be adjusted without undesirably degrading speech produced by said system.

8. The system as in claim 7 wherein each said natural timing interval is a respective syllable.

9. The system as in claim 7 wherein each said natural timing interval is a respective interval between two respective stressed phonemes.

10. The system as in claim 7 wherein said computer memory is a read only memory ROM.

11. The system as in claim 7 wherein said computer memory is a computer disk.

12. A synthetic speech system comprising:

a computer process for detecting natural timing boundaries in words to be spoken by said synthetic speech system, to produce natural timing intervals, said words stored in a computer memory;

a computer process for identifying phonemes in said natural timing intervals;

a computer process for assigning first time durations for each of said phonemes;

a computer process for changing a selected first time duration of a selected phoneme to achieve a desired time duration for a selected natural timing interval containing said selected phoneme; and a computer process for setting a plurality of said natural timing intervals to substantially the same second time duration, a particular phoneme having a computed time duration in response to number of phonemes within said selected natural timing interval and said second time duration;

wherein at least one respective time duration of at least one respective phoneme is based upon a selectable parameter indicative of degree to which the at least one respective time duration is adjustable without undesirably degrading speech produced by the system.

13. The system as in claim 12 further comprising:

a computer process for dividing said phonemes into at least two groups, a first group of extensible phonemes and a second group of fixed phonemes, and to adjust respective time durations of said extensible phonemes while not adjusting respective time durations of said fixed phonemes.

14. The system as in claim 12 further comprising:

a computer process for adjusting a speaking rate by adjusting the respective time durations of extensible phonemes within each natural timing interval.

15. The system as in claim 12 wherein said system is configured to generate audible speech in at least one of a syllable timed rhythm language and a stress timed rhythm language.

16. A synthetic speech system comprising:

a computer process for detecting natural timing boundaries in words including syllables to be spoken by said synthetic speech system, to produce natural timing intervals, said words being stored in a computer memory and each of said natural timing intervals involving a respective syllable;

a computer process for identifying phonemes in each syllable, said phonemes including flexible and inflexible phonemes;

a computer process for assigning first time durations for each of said phonemes; and a computer process for achieving a selected percentage of syllable timed rhythm in synthesized speech by adjusting a respective inherent time interval for each respective flexible phoneme to adjust a respective syllable time duration to be within said selected percentage of a reference duration, said reference duration being computed from a desired speaking rate, and respective time durations of said inflexible phonemes not being adjusted based upon said selected percentage.

17. A synthetic speech system comprising;

a computer process for detecting natural timing boundaries in words including syllables to be spoken by said synthetic speech system, to produce natural timing intervals, said words being stored in a computer memory, and each natural timing interval involving a respective stressed time interval between respective stressed syllables;

a computer process for identifying phonemes in said stressed time interval, said phonemes including fixed and flexible phonemes;

a computer process for assigning first time durations for each of said phonemes; and a computer process for achieving a selected percentage of stress timed rhythm in synthesized speech by adjusting an inherent time interval for at least one flexible phoneme in a respective stressed time interval to adjust a respective time duration of said respective stressed time interval to be within said selected percentage of a reference duration, said reference duration being computed from a desired speaking rate, and respective time durations of said fixed phonemes not being adjusted based upon said selected percentage.

* * * * *